United States Patent [19]

Lavin et al.

[11] 4,019,859

[45] Apr. 26, 1977

[54] TRIETHYLENE TETRAMINE STABILIZATION OF COBALT CATALYZED SULFITE SOLUTIONS AND USE THEREOF IN CONTROLLING OXYGEN CORROSION IN BOILER WATER SYSTEMS

[75] Inventors: Walter M. Lavin, Horsham; James I. McFarlane, Warminster; Dennis L. Rose, Fairless Hills, all of Pa.

[73] Assignee: Betz Laboratories, Inc., Trevose, Pa.

[22] Filed: Sept. 20, 1976

[21] Appl. No.: 724,443

[52] U.S. Cl. ..... 21/2.7 R; 210/59; 252/81; 252/87; 252/178; 252/181; 252/389 R; 423/551

[51] Int. Cl.[2] ..... C23F 11/04; C02B 1/23; C02B 1/10; C02B 5/06

[58] Field of Search ..... 21/2.7 R; 210/59; 252/389 R, 82, 180, 178, 181, 81, 87

[56] References Cited

UNITED STATES PATENTS

| | | | |
|---|---|---|---|
| 2,580,923 | 1/1952 | Jacoby | 21/2.7 R |
| 2,582,138 | 1/1952 | Lane et al. | 21/2.6 R X |
| 3,235,324 | 2/1966 | Merriman | 252/87 X |
| 3,382,186 | 5/1968 | Silverstein | 21/2.7 R X |
| 3,520,813 | 7/1970 | Hansen et al. | 21/2.7 R X |
| 3,634,232 | 1/1972 | Dunlop | 21/2.7 R X |
| 3,899,293 | 8/1975 | Bush | 21/2.7 R X |
| 3,976,593 | 8/1976 | Hartke et al. | 21/2.7 R X |

*Primary Examiner*—Barry S. Richman
*Attorney, Agent, or Firm*—Alexander D. Ricci; Steven H. Markowitz

[57] ABSTRACT

A method of stabilizing aqueous solutions containing alkali metal sulfite or bisulfite and a catalyst therefor by incorporating in said solutions a stabilizing amount of triethylene tetramine. The catalyzed sulfites which are of primary concern in the present instance are those which are used to inhibit or control oxygen corrosion in water treatment, particularly boiler water treatment.

18 Claims, No Drawings

TRIETHYLENE TETRAMINE STABILIZATION OF COBALT CATALYZED SULFITE SOLUTIONS AND USE THEREOF IN CONTROLLING OXYGEN CORROSION IN BOILER WATER SYSTEMS

BACKGROUND OF THE INVENTION

As described quite thoroughly on pages 166 through 169 of the *Bentz Handbook of Industrial Water Conditioning*, 6th Edition, 1962, Betz Laboratories, Inc. Trevose, Pennsylvania, the control of dissolved oxygen in water systems, particularly boiler water or more generally steam producing systems, is a must because of its capacity to promote the corrosion of metallic parts in contact with the water.

Dissolved oxygen can be introduced into the system not only in the makeup water but also due to air infiltration of the condensate system. When dissolved oxygen is present in the feedwater, an attack of the feed lines, closed heaters and economizer can be expected with the severity of the problem dependent on the concentration of dissolved oxygen and the temperatures involved. One of the most serious aspects of oxygen corrosion is that it generally occurs as pitting so that the attack is concentrated in a small area of the total metal surface. With this type of corrosion, failures can occur even though only a relative small portion of the metal has been lost.

The influence on the corrosivity of dissolved oxygen is particularly important in such equipment as closed heaters and economizers where the water temperature is increased very rapidly. Under such conditions, an additional driving force for the oxidation reaction is present and for this reason, even very small quantities of dissovled oxygen in feedwater can cause severe corrosion in such equipment.

When oxygen is present in the feedwater entering the boiler, a portion will be flashed and will leave the boiler with the steam. The remainder of the dissolved oxygen can attack the boiler metal. While the point of attack will vary with the boiler design and feedwater distribution, oxygen pitting is usually concentrated adjacent to the water level in the feedwater drum.

The first and most important step in eliminating the corrosive influence of dissolved oxygen is mechanical deaeration of the boiler feedwater. Efficient deaeration will reduce the dissolved oxygen content of the boiler feedwater to a very low value. It is advisable to follow mechanical deaeration by chemical deaeration in order to remove the last traces of dissolved oxygen. Where mechanical deaeration is not employed, chemical deaeration must be used for the removal of the entire oxygen content of the feedwater. Alkali metal sulfites and bisulfites, for example sodium-sulfite and sodium bisulfite, are the chemical agents most commonly employed for chemical deaeration due to their low cost, ease of handling and their lack of scale forming properties. The oxygen scavenging characteristics of sodium sulfite are illustrated by the following reaction:

$$2Na_2SO_3 + O_2 = 2Na_2SO_4$$

(sodium sulfite + oxygen = sodium sulfate)

The reaction with sodium bisulfite is of course similar.

The removal of 1.0 ppm dissolved oxygen theoretically requires 7.88 ppm of chemically pure sulfite. However, use of a technical grade of sodium sulfite or bisulfite with handling and blowdown losses as encountered in actual plant operation usually requires the feed of approximately 10 pounds of sodium sulfite or bisulfite for each pound of oxygen. Requirements will also depend on the concentration of excess sulfite maintained in the boiler water.

To assure complete oxygen removal, it is necessary to maintain a residual concentration of sulfite in the boiler water. The residual required depends on a number of factors such as the method of feed and the point of application, the dissolved oxygen concentration and the variation in the dissolved oxygen concentration of the feedwater.

Continuous feed of the sodium sulfites is generally required for complete oxygen removal. In the majority of plants, the most suitable point of application is the storage compartment of the deaerating or open heater. In other plants, sufficient reaction time will be allowed with application to the suction side of the boiler feed pump. While intermittent application is generally not recommended, it has been found in some low pressure systems that adequate protection is provided as long as the additions of sodium sulfite are made with sufficient frequency to continuously maintain the proper residual concentration in the boiler water.

Testing of the boiler water for sulfite residual and recording the quantity of sulfite required serves also as a quick check on heater deaeration efficiency in those plants where the oxygen content of the feedwater is not determined regularly. Any decrease in boiler water sulfite residual, and consequent need for increased feed of sodium sulfites, is an indication that heater operation should be checked to ascertain and correct the reason for increased oxygen content of the boiler feedwater.

The speed of the sulfite-oxygen reaction is affected by a number of factors, the most important being temperature. The reaction time decreases with increased temperature. In general, the reaction speed doubles for every 10° C increase in temperature. At temperatures of 212° F and above the reaction is quite rapid. It has also been found that the presence of an excess or overfeed of the sodium sulfites will increase the reaction rate. Several investigators have shown that the reaction proceeds most rapidly at pH values in the vicinity of 9.0 – 10.0.

Research directed toward increasing the speed of the oxygen sulfite reaction has determined that certain water-soluble materials act as catalysts in speeding this reaction to completion. The most suitable catalysts are the heavy metal cations of two or more valences. Iron, copper, cobalt, nickel managanese are among the more effective catalytic aids to the oxygen-sulfite reaction. Combinations of several of these heavy metal cations have proved effective in providing a continuously active influence on the speed of reaction. The catalysts are introduced as their water-soluble salts, i.e., chloride, sulfate, nitrate, etc.

As a result of reasearch on catalytic aids for oxygen removal, catalyzed sodium sulfite and sodium bisulfite formulations were developed. Through the incorporation of suitable catalysts and the sodium sulfites in one formulation, a material was available which would consistently provide practically instantaneous oxygen removal, even when the water possesses natural inhibitory properties. The concentration of the catalyst added is dependent upon the sulfite concentration in the solution. Concentrations of the catalyst of 0.05 to 1.0% by weight of the weight of sulfite present have been found to be effective. Most commonly, the weight used is approximately 0.1%.

Catalyzed sodium sulfite or bisulfite is used in low temperature systems for oxygen removal and also finds application in boiler systems where the feedwater temperature is low, where mechanical deaeration is not complete or where it is essential to obtain rapid reaction for prevention of pitting in feed lines, closed heaters and economizers.

As indicated in the foregoing discussion, the use of catalysts in conjunction with the sodium sulfite and bisulfite has proven quite effective. However, there is a problem associated with aqueous solutions of these products, particularly aqueous solutions of sodium bisulfite, which occurs during storage in storage tanks. Unusual as it may seem, the problem did not occur when the product was contained for example in drums. It was discovered that at several locations having an aqueous solution containing 33% sodium bisulfite and 0.1% cobalt chloride catalyst (based on weight of bisulfite) stored in large bulk tanks the solution contained a reddish brown sludge which resulted in clogged feed lines and pumps, causing shutdowns.

Samples of the reddish brown sludge were analyzed and found to be composed of cobalt sulfite. Retained samples of the solution showed no evidence of any precipitation even in samples over two years old.

It was accordingly concluded that the products evidencing precipitation had been subjected to conditions during bulk storage which promoted the instability of the sodium bisulfite/cobalt chloride solution.

Since the precipitation of $CoSO_3$ occurred only in vented bulk storage tanks, it was assumed that the loss of sulfur dioxide gas from the cobalt catalyzed bisulfite solution was a critical factor in the precipitation. The decrease in the concentration of $NaHSO_3$ in the complaint samples could be attributed to the evolution of sulfur dioxide gas. This explained the pH in the sludged samples, since bisulfite solutions evolve sulfur dioxide according to the reaction:

$$2HSO_3^- \rightarrow SO_2\uparrow + H_2O + SO_3^=$$

The net reaction results in the loss of two bilsulfite protons to water and the formation of a sulfite ion. The pH and sulfite ion concentration of an open air bisulfite solution rises as sulfur dioxide is evolved. The increase in the sulfite ion concentration accompanying the evolution of $SO_2$ gas leads to formation of cobalt sulfite.

This mechanism was proved in the laboratory by dividing a sodium bisulfite/cobalt chloride into two jars. One jar was vented with a small hole in the lid while the other was tightly sealed. The starting pH was 3.2. Over a period of one month the sealed jar maintained its pH of 3.2. The pH of the solution in the vented jar rose to 5.1 and a red precipitate of cobalt sulfite formed on the bottom of the jar. The sulfite ion concentration of a bisulfite solution was also increased by addition of enough caustic to raise the pH from 3.8 to 5.0. The precipitation of cobalt sulfite occurred overnight.

Applicants considered, but quickly eliminated, solutions to the problems proposed including mechanical adjustments to the tanks, addition of acid in the field to maintain a low pH, and replacement of the catalyst with one more stable under higher pH.

GENERAL DESCRIPTION OF THE INVENTION

In performing research directed to the problem it was concluded that since the cobalt ion is soluble in the bisulfite solution at low pH, i.e., 3.5 or less, and precipitates as a sulfite salt at high pH's, i.e., above 4.3, an attempt would be made to utilize a stabilizing agent, perhaps even a chelating agent, which would not make the cobalt ion available under increasing pH conditions.

It was discovered that if a stabilizing amount of certain and only certain compounds was added to a bisulfite/cobalt solution which was likely to undergo an increase in pH to eliminate the formation of the precipitate cobalt sulfite, the cobalt remained in solution under increasing pH conditions and the cobalt's performance as a catalyst was not effected. It was also discovered that although some compounds did indeed effectively inhibit the formation of precipitate at increasing pH's, the effectiveness of the cobalt was retarded. The material which was found to be effective and which is the subject of this application is triethylene tetramine. Hydroxy ethylidene diphosphonic acid and derivatives thereof were also found to be effective and are the subject of a separate application.

The amount of stabilizing agent necessary is a function of the cobalt ion concentration in the aqueous solution of sodium bisulfite. The tests conducted indicated that an amount ranging from a stoichiometric amount to about four (4) moles of stabilizing agent for each mole of catalyzing metal ion would be most effective from an efficacy point of view as well as an economic one. The preferred amount of course is the least that is required to perform the function, which is in most cases in the proximity of a stoichiometric amount. The individual ingredients are all water-soluble and accordingly the composition can be made by simple blending operations.

For example, to a composition comprising on a weight basis 33% sodium bisulfite, 0.1% cobalt chloride, and 66.9% water is added sufficient triethylene tetramine (0.20% by weight) to produce a mole ratio of amine stabilizer to cobalt ion of 1.77 : 1.0.

TESTING

Various materials were tested to establish each one's efficacy in stabilizing cobalt chloride catalyzed bisulfite solutions. These materials were added in various concentrations to 100 gram lots of aqueous solutions of sodium bisulfite/cobalt chloride (33% + 0.1% + 66.9%) contained in uncapped bottles. The samples bearing the added materials together with standard samples (untreated) were kept at 100° F for 72 hours in open air. It was determined that under these conditions the untreated bisulfite/cobalt solution would undergo precipitate formation.

The test results were as follows:

TABLE 1

| Stabilizer Added | % By Weight | Stabilizer Molar ratio / $Co^{+2}$ | Initial pH | Appearance 72 hours | Final pH |
|---|---|---|---|---|---|
| FIRST SERIES | | | | | |
| Blank | — | — | 3.5 | Red precipitate | 5.1 |

TABLE 1-continued

| Stabilizer Added | % By Weight | Stabilizer Molar ratio / $Co^{+2}$ | Initial pH | Appearance 72 hours | Final pH |
|---|---|---|---|---|---|
| EDTA $Na_4$ | 1.0 | 3.5 – 1 | 3.6 | Clear tan solution | 5.1 |
| Sulfamic acid | 0.5 | 6.7 – 1 | 3.4 | Red precipitate | 5.1 |
| Nitrilo tri (methylene phosphonic acid) | 0.5 | 2.17 – 1 | 3.3 | Clear purple solution | 5.1 |
| Hydroxyethylidene diphosphonic acid | 0.6 | 3.78 – 1 | 3.3 | Clear Purple solution | 5.1 |
| Hexamethylene diamine(tetramethylene phosphonic acid) | 0.5 | 1.32 – 1 | 3.4 | Red precipitate | 5.1 |
| Ethylenediamine | 0.5 | 10.8 – 1 | 3.6 | Red precipitate | 5.1 |
| Morpholine | 0.5 | 7.5 – 1 | 3.6 | Red precipitate | 5.1 |
| Triethanolamine | 0.5 | 4.4 – 1 | 3.6 | Red precipitate | 5.1 |
| Ammonium Hydroxide | 0.5 | 7.0 – 1 | 3.6 | Red precipitate | 5.1 |
| Pentaethylenehexamine | 0.5 | 2.77 – 1 | 3.6 | Clear tan solution | 5.1 |
| Triethylene tetramine | 0.5 | 4.44 – 1 | 3.6 | Clear tan solution | 5.1 |
| SECOND SERIES | | | | | |
| Blank | — | — | 3.8 | Red precipitate | 5.1 |
| Hydroxyethylidene diphosphonic acid | 0.3 | 1.89 – 1 | 3.7 | Clear purple solution | 5.1 |
| Nitrilo tri (methylene phosphonic acid) | 0.25 | 1.08 – 1 | 3.7 | Red precipitate | 5.1 |
| Pentaethylenehexamine | 0.2 | 1.10 – 1 | 3.9 | Clear tan solution | 5.1 |
| EDTA $Na_4$ | 0.4 | 1.39 – 1 | 3.9 | Clear tan solution | 5.1 |
| Triethylene tetramine | 0.2 | 1.77 – 1 | 3.8 | Clear tan solution | 5.1 |
| THIRD SERIES | | | | | |
| Blank | — | — | 3.7 | Red precipitate | 5.1 |
| Hydroxethylidene diphosphonic acid | 0.18 | 1.13 – 1 | 3.6 | Clear purple solution | 5.1 |
| Pentaethylenehexamine | 0.1 | 0.55 – 1 | 3.8 | Red precipitate | 5.1 |
| EDTA $Na_4$ | 0.3 | 1.05 – 1 | 3.8 | Red precipitate | 5.1 |
| Triethylene tetramine | 0.1 | 0.89 – 1 | 3.8 | Red precipitate | 5.1 |

The foregoing data illustrate conclusively that the amine compound was effective for the purpose. It is apparent that certain other compounds, amine and acetic acid derivatives, were also found to be effective to a certain extent; however, upon subsequent testing as described below their use was eliminated.

In order to assure that product effectiveness was not hindered by the addition of the stabilizers, product effectiveness tests were performed on experimental boilers. These tests established that the addition of the amine did not hinder the catalyzing effect of a cobalt catalyzed bisulfite. In fact, preliminary tests concluded that the oxygen uptake was accelerated. The presence of the stablizing agent appeared to enhance the catalytic effect of cobalt. However, this was not the case with pentaethylenehexamine, the tetra sodium salt of ethylenediamine tetraacetic, or the tri sodium salt of nitrilo triacetic acid. Upon testing it was determined that these stabilizers, with the exception of the phosphonic acid compound, in fact retarded oxygen uptake and accordingly were concluded to be unsuitable.

As indicated earlier, catalysts containing metal cations such as iron, copper, nickel and manganese have also been used successfully. In order to establish the efficacy of the subject amine as a stabilizer, tests similar to those aforedescribed under the heading "Testing" were conducted using catalysts of iron, manganese, nickel and copper. Copper presented no problems from a precipitation standpoint, however, the iron, manganese and nickel catalysts did indeed precipitate when pH was increased. However, the addition of the subject amine did not alleviate this problem. Consequently, it was evident that the stabilization was peculiar to the amine in conjunction with the cobalt catalyst.

Accordingly, having described our invention what is claimed is:

1. A method of stabilizing an aqueous solution of an alkali metal sulfite or bisulfite containing a water-soluble cobalt catalyst, which solution with an increase of pH will experience the precipitation of a said cobalt as its sulfite salt, which method comprises incorporating in said solution a stabilizing amount of triethylene tetramine.

2. A method according to claim 1, wherein the cobalt catalyst is selected from the group consisting of cobalt chloride and cobalt sulfate.

3. A method according to claim 1, wherein said triethylene tetramine is added in an amount from 1 to 4 moles per mole of cobalt cation is the catalyst.

4. A method according to claim 3, wherein the cobalt catalyst is selected from the group consisting of cobalt sulfate and cobalt chloride.

5. A method according to claim 4, wherein the alkali metal sulfite or bisulfite is sodium sulfite or sodium bisulfite.

6. A method according to claim 1, wherein the amount of cobalt catalyst present is from about 0.05 to 1% by weight of the alkali metal sulfite or bisulfite, and the triethylene tetramine is incorporated in an amount of from about 1 mole to 4 moles per mole of metal catalyst.

7. A method according to claim 6, wherein the cobalt catalyst is selected from the group consisting of cobalt sulfate and cobalt chloride.

8. A method according to claim 7, wherein the alkali metal sulfite or bisulfite is sodium sulfite or sodium bisulfite.

9. A composition for use as an oxygen scanvenger for oxygen dissolved in an aqueous solution which comprises: an alkali metal sulfite or bisulfite, a water-soluble cobalt catalyst, and a stabilizing amount of triethylene tetramine.

10. A composition according to claim 9, wherein the cobalt catalyst is selected from the group consisting of cobalt chloride and cobalt sulfate.

11. A composition according to claim 10, wherein the sulfite or bisulfite is sodium sulfite or sodium bisulfite.

12. A composition according to claim 9, wherein the sulfite or bisulfite is sodium sulfite or sodium bisulfite.

13. A composition according to claim 12, wherein the composition is an aqueous solution, the amount of cobalt catalyst present is from 0.05 to 1% by weight of the sulfite, and the triethylene tetramine to catalyst mole ratio is from 1:1 to 4:1.

14. A composition according to claim 13, wherein the cobalt catalyst is selected from the group consisting of cobalt chloride and cobalt sulfate.

15. A method of controlling oxygen corrosion in a boiler water system due to the dissolved oxygen in the water which comprises adding to said boiler water an oxygen scavenging amount of a composition comprising an alkali metal sulfite or bisulfite, a water-soluble cobalt catalyst, and a stabilizing amount of triethylene tetramine.

16. A method according to claim 15, wherein the composition is an aqueous solution, the amount of cobalt catalyst present is from 0.05 to 1% by weight of the sulfite, and the triethylene tetramine to catalyst mole ratio is from 1:1 to 4:1.

17. A method according to claim 16, wherein the cobalt catalyst is selected from the group consisting of cobalt chloride and cobalt sulfate.

18. A method according to claim 17, wherein the sulfite or bisulfite is sodium sulfite or sodium bisulfite.

* * * * *